US011937691B2

(12) United States Patent
Bailey

(10) Patent No.: US 11,937,691 B2
(45) Date of Patent: Mar. 26, 2024

(54) SYSTEMS AND METHODS OF A LUGGAGE RACK

(71) Applicant: William Bailey, Bluffton, SC (US)

(72) Inventor: William Bailey, Bluffton, SC (US)

( * ) Notice: Subject to any disclaimer, the term of this patent is extended or adjusted under 35 U.S.C. 154(b) by 0 days.

(21) Appl. No.: 17/484,404

(22) Filed: Sep. 24, 2021

(65) Prior Publication Data

US 2023/0101062 A1 Mar. 30, 2023

(51) Int. Cl.

| | |
|---|---|
| ***A47B 43/00*** | (2006.01) |
| ***A47B 57/04*** | (2006.01) |
| ***A47B 57/10*** | (2006.01) |
| ***A47F 5/10*** | (2006.01) |
| *A47B 45/00* | (2006.01) |

(52) U.S. Cl.

CPC ..... *A47B 43/00* (2013.01); *A47B 57/045* (2013.01); *A47B 57/10* (2013.01); *A47F 5/10* (2013.01); *A47B 45/00* (2013.01)

(58) Field of Classification Search

CPC ..... A47B 43/00; A47B 57/045; A47B 57/10; A47B 45/00; A47B 57/04; A47B 57/06; A47B 61/06; A47B 61/02; A47B 81/00; A47B 3/02; A47B 2003/045; A47F 5/10; D06F 57/08; A47G 25/0664; A47G 25/0685

USPC ..... 211/195

See application file for complete search history.

(56) References Cited

U.S. PATENT DOCUMENTS

| | | | | | |
|---|---|---|---|---|---|
| 107,199 | A * | 9/1870 | Richardson | D06F 57/08 | 211/198 |
| 1,407,912 | A * | 2/1922 | Bates | A47B 43/04 | 211/180 |
| 1,427,173 | A * | 8/1922 | Stoll | B60R 9/02 | 224/42.36 |
| 1,548,392 | A * | 8/1925 | Stites | A47B 5/04 | 211/195 |
| 1,979,152 | A * | 10/1934 | Green | A47C 16/025 | 211/195 |
| 2,305,629 | A * | 12/1942 | Magnuson | A47B 43/00 | 211/195 |
| 2,415,784 | A * | 2/1947 | Block | D06F 95/002 | 211/200 |
| 2,928,551 | A * | 3/1960 | Abrams | A47F 5/0087 | 248/240.4 |
| 2,939,584 | A * | 6/1960 | Bergman, Jr. | A47F 5/13 | 248/164 |
| 3,033,379 | A * | 5/1962 | Clark | D06F 57/08 | 211/200 |
| 3,162,311 | A * | 12/1964 | Scott | A47B 61/04 | 211/34 |
| 3,189,380 | A * | 6/1965 | Reguitti | A47C 7/64 | 297/188.1 |

(Continued)

FOREIGN PATENT DOCUMENTS

KR 200472629 Y1 * 5/2014

*Primary Examiner* — Devin K Barnett
(74) *Attorney, Agent, or Firm* — Troutman Pepper Hamilton Sanders LLP; Ryan A. Schneider

(57) ABSTRACT

A luggage rack including a framework, a shelf tier, and a folding system configured to transition the luggage rack between a first and a second configurations of the luggage rack. The shelf tier can include a first position associated with the first configuration of the luggage rack and a second position associated with the second configuration of the luggage rack.

11 Claims, 8 Drawing Sheets

(56) References Cited

U.S. PATENT DOCUMENTS 3,295,471 A * 1/1967 Cook ..... A47F 5/13 108/163
4,188,890 A * 2/1980 de Villers ..... A47B 81/00 108/30
4,556,249 A * 12/1985 Kassai ..... A47D 1/023 297/30
D322,698 S * 12/1991 Cassel ..... D32/58
5,146,635 A * 9/1992 Gastle ..... A61D 3/00 119/757
5,190,254 A * 3/1993 Maguire ..... F16M 11/245 248/164
5,439,152 A * 8/1995 Campbell ..... B60R 9/00 211/195
5,505,318 A * 4/1996 Goff ..... E04G 17/002 211/90.03
6,164,465 A * 12/2000 Schroeder ..... A63B 71/0036 211/85.7
D451,304 S * 12/2001 Felsenthal ..... D6/678.4
6,443,321 B1 * 9/2002 Felsenthal ..... A47G 25/0664 211/195
6,702,129 B1 * 3/2004 Harris ..... A47G 25/0664 211/172
9,909,250 B1 * 3/2018 Greenspon ..... A47G 25/0685
D960,620 S * 8/2022 Pelosi ..... D6/678.4
2007/0012638 A1 * 1/2007 Van Eijk ..... D06F 57/08 211/104
2008/0035391 A1 * 2/2008 Jewett ..... G01G 19/52 177/144
2016/0167748 A1 * 6/2016 Dias ..... B63B 32/83 211/85.7
2017/0119152 A1 * 5/2017 Zhu ..... A47B 61/04
2017/0135469 A1 * 5/2017 Kimmich ..... A47B 81/00
2017/0245637 A1 * 8/2017 Zhu ..... A47B 61/04
2018/0163339 A1 * 6/2018 Greenspon ..... D06F 57/08
2021/0161290 A1 * 6/2021 Leung ..... A47F 5/10
2022/0142358 A1 * 5/2022 Felsenthal ..... A47B 61/06

* cited by examiner

SYSTEMS AND METHODS OF A LUGGAGE RACK

FIELD OF THE TECHNOLOGY

The present disclosure relates to systems and methods of a luggage rack.

BACKGROUND

Aspects of the present application relates to the field of furniture. More particularly, it relates to an apparatus used to place or store luggage in an organized manner such that a user can easily pack or unpack their belongings. Some of these apparatuses involve a single shelf on which to place an article, such as a bag.

Related luggage racks are designed to accommodate a single article, and as a result, these related art apparatuses are awkward to use when two individuals, having separate luggage, wish to unpack or pack their belongings at the same time. As it will be appreciated, having two independent single shelved luggage racks can be expensive, cumbersome to store, and cannot be readily stacked thus requiring additional space for use.

Other related art luggage racks do not adjust in height causing inconvenience and body pain to taller or shorter users when packing or unpacking their belongings.

Aspects of the present disclosure address these and other disadvantages.

SUMMARY

Disclosed examples provide systems and methods for a luggage rack including a framework, a shelf tier, and a folding system that can be configured to transition the luggage rack between a first and a second configurations of the luggage rack. Additionally, the shelf tier can include a first position associated with the first configuration of the luggage rack and a second position associated with the second configuration of the luggage rack.

In an example, the luggage rack can include a folding mechanism that can be configured to transition the shelf tier between the first position and the second position.

In an example, the folding mechanism can include a first portion attached to the shelf tier, and a second portion attached to the framework.

In an example, the framework can include a first position associated with the first configuration of the luggage rack and a second position associated with the second configuration of the luggage rack.

In an example, the framework in the first position can substantially abuts a floor.

In an example, the framework in the second position can include a distance between the framework and a floor.

In an example, the luggage rack can include an adjustment system that can be configured to transition the framework between a first and a second length. The adjustment system can include an adjustment mechanism that can be disposed on at least one of: the shelf tier or the framework.

In an example, the shelf tier can be a first shelf tier, and can also include a second shelf tier that can include a first position associated with the first configuration of the luggage rack and a second position associated with the second configuration of the luggage rack.

In an example, the luggage rack can include a folding system that can be configured to transition the luggage rack between the first and the second configurations of the luggage rack. The folding system can also include a folding mechanism that can be configured to transition the second shelf tier between the first position and the second position.

In an example, the folding mechanism can include a first end of a folding system member attached to the second shelf tier; and a second end of the folding system member attached to the framework.

In an example, the folding mechanism can include a first end of a folding system member attached to the second shelf tier; and a second end of the folding system member in communication with the framework.

In an example, the shelf tier can include a shelf member and a shelf support structure.

In an example, the shelf support structure can include one or more support members, wherein one support member can be in a substantially perpendicular configuration with respect to the framework in the first position of the shelf support structure.

In an example, the shelf support structure can include one or more support members, wherein one support member can be in a substantially non-perpendicular configuration with respect to the framework in the second position of the shelf support structure.

In an example, the framework can include a framework member.

In an example, the framework member can be a first framework member, the framework can include a multi-purpose member being attached to the shelf tier and can be configured to (i) brace the framework, and (ii) receive objects placed on said multi-purpose member, and can include a first end attached to the first framework member, and a second end attached to a second framework member.

Consistent with the disclosed examples, a method is disclosed. In an example, the method can include attaching a shelf tier to a framework such that the shelf tier is operable to transition between a first position of the shelf tier and a second position of the shelf tier, and such that the framework is operable to transition between a first position of the framework and a second position of the framework.

In an example, attaching a shelf tier to the framework can include coupling a first shelf support member to a second shelf support member such that the first shelf support member and the second shelf support member are rotatable about a first axis. Additionally, the method can include attaching a shelf member at a first end of the first shelf support member, attaching a multi-purpose member at a first end of the second shelf support member, attaching a first end of the multi-purpose member to a framework member such that the multi-purpose member is rotatable about a second axis; and attaching a second end of the first shelf support member to a first end of the framework member such that the framework member slides with respect to the first shelf support member.

In an example, the shelf tier is a first shelf tier, the method can include attaching a second shelf tier to the framework such that the second shelf tier is operable to transition between a first position of the second shelf tier and a second position of the second shelf tier.

In an example, attaching a second shelf tier to the framework can include attaching a shelf member to a first end of a shelf support member, and attaching a second shelf member to a second end of the shelf support member, and attaching the second end of the shelf support member to an end of a framework member such that the shelf support member is rotatable with respect to the framework member.

BRIEF DESCRIPTION OF THE DRAWINGS

Reference will now be made to the accompanying drawings, which are not necessarily drawn to scale, and which are incorporated into and constitute a portion of this disclosure, illustrate various implementations and aspects of the disclosed technology and, together with the description, serve to explain the principles of the disclosed technology. In the drawings.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION

Some implementations of the disclosed technology will be described more fully with reference to the accompanying drawings. This disclosed technology may, however, be embodied in many different forms and should not be construed as limited to the implementations set forth herein. The components described hereinafter as making up various elements of the disclosed technology are intended to be illustrative and not restrictive. Many suitable components that would perform the same or similar functions as components described herein are intended to be embraced within the scope of the disclosed devices and methods. Such other components not described herein may include, but are not limited to, for example, components developed after development of the disclosed technology.

It is also to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

Reference will now be made in detail to examples of the disclosed technology, examples of which are illustrated in the accompanying drawings and disclosed herein. Wherever convenient, the same references numbers will be used throughout the drawings to refer to the same or like parts.

Figure 1A:
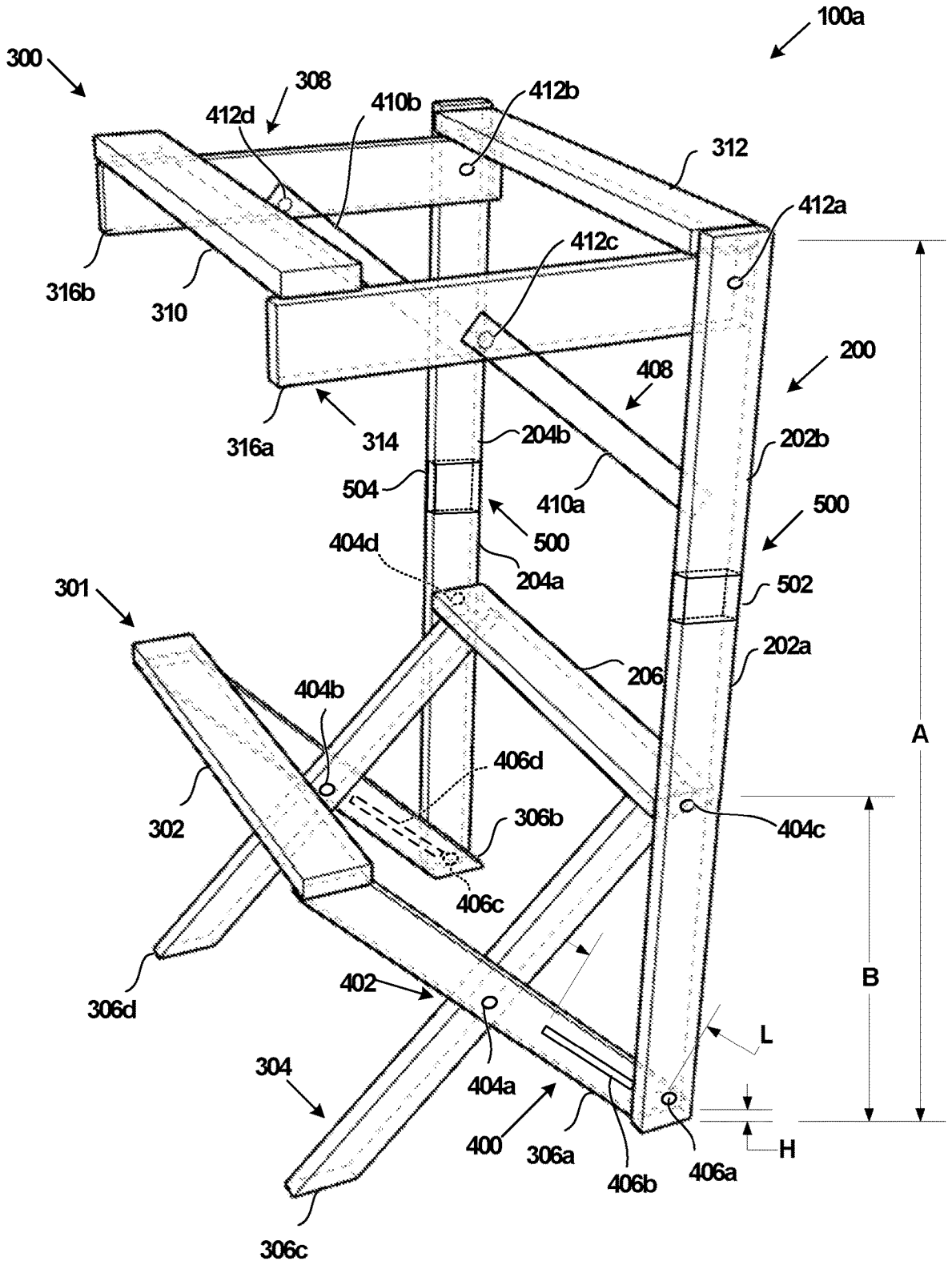
FIG. 1A illustrates aspects of an example luggage rack in a first configuration, according to aspects of the present disclosure.

FIG. 1A illustrates an example of a luggage rack system 100 in a first configuration. The luggage rack system 100 can include a framework 200, a shelving system 300, a folding system 400. Additionally, the luggage rack system 100 can include an adjustment system 500. The first configuration of the luggage rack system 100 can be an extended configuration. Additionally or alternatively, the first configuration of the luggage rack system 100 can be a fully extended configuration. In the first configuration of the luggage rack system 100, the framework 200 can include a first position such that the framework 200 substantially abuts a floor and is a distance H above the floor, the distance H can be approximately zero inches. In an example, in the first configuration of the luggage rack system 100, the framework 200 can include a first position such that the distance H can be approximately zero inches to approximately three inches, four inches, five inches, or six inches above the floor.

Figure 1B:
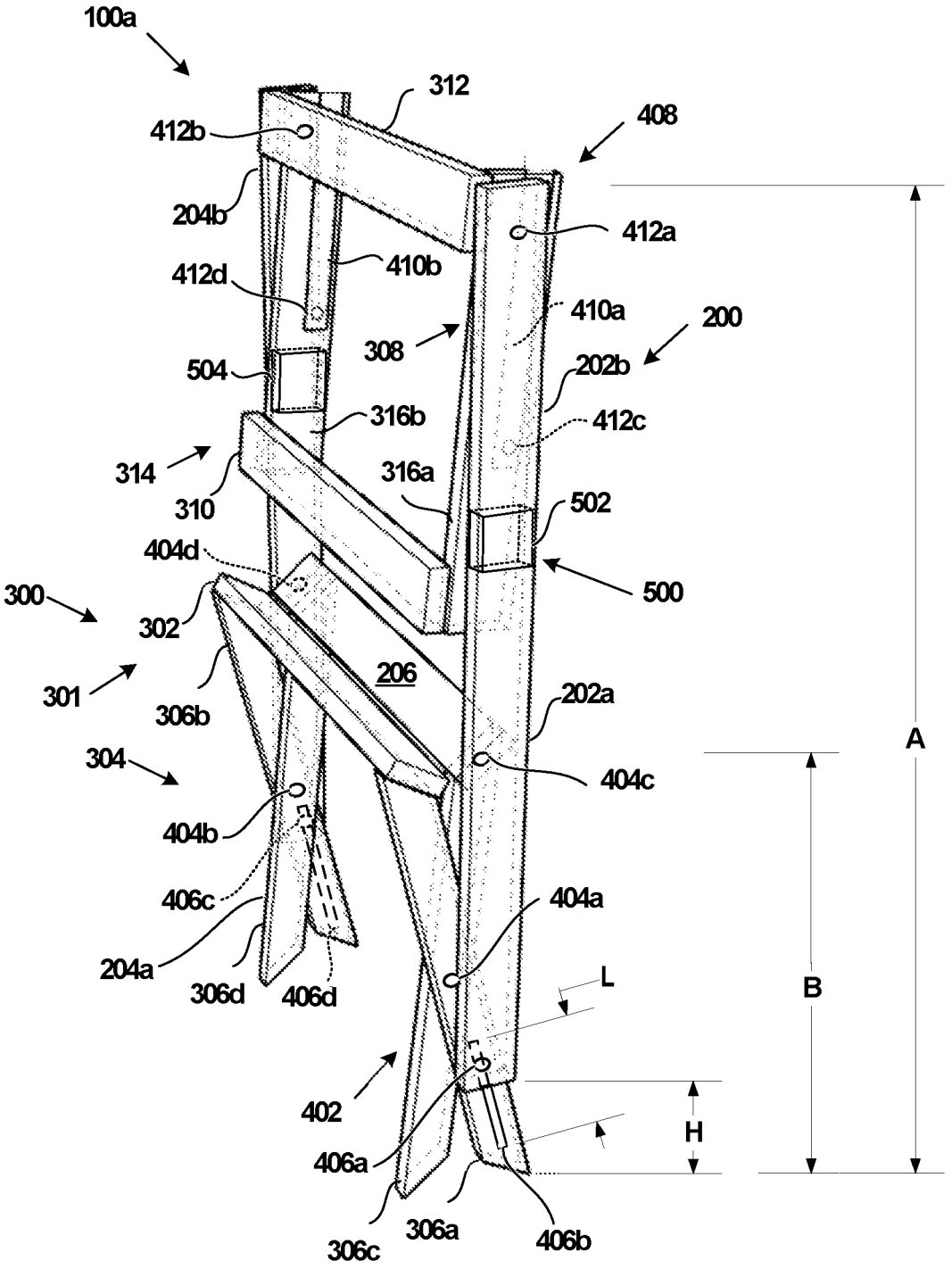
FIG. 1B illustrates aspects of an example luggage rack in a second configuration, according to aspects of the present disclosure.

FIG. 1B illustrates an example of a luggage rack system 100 in a second configuration. The second configuration of the luggage rack system 100 can be a retracted configuration. Additionally or alternatively, the second configuration of the luggage rack system 100 can be a fully retracted configuration. In the second configuration of the luggage rack system 100, the framework 200 can include a second position such that the framework 200 does not substantially abut a floor and is a distance H above the floor, the distance H can be greater than zero inches. In an example, in the second configuration of the luggage rack system 100, the framework 200 can include a second position such that the distance H can be three inches or greater above the floor. In examples, the distance H can range from approximately 0.5 inches to approximately 6 inches. Additional configurations of the luggage rack system 100 are contemplated. Additional positions of the framework 200 are contemplated. Additionally, the luggage rack system 100 can be mounted to a wall or support structure using a mount disposed on, for example, the framework 200. For example, in a mounted luggage rack system 100, the distance H in the retracted configuration can be approximately 3 inches from the distance H in the extended configuration.

Turning back to FIG. 1A, the framework 200 can include a first plurality of framework members 202*a*, 202*b*, a second plurality of framework members 204*a*, 204*b*, and/or a multi-purpose member 206. Additionally or alternatively, the first plurality of framework members 202*a*, 202*b*, the second plurality of framework members 204*a*, 204*b*, and/or the multi-purpose member 206 can be integral forming a unibody structure of the framework 200. In an example, the first plurality of framework members 202*a*, 202*b* can be integral thereby forming a single framework member. In an example, the second plurality of framework members 204*a*, 204*b* can be integral thereby forming a single framework member. Additionally, the framework 200 can include a bar configured to receive aspects of the folding system 400. The bar can be attached to the first plurality of framework members 202*a*, 202*b* and/or the second plurality of framework members 204*a*, 204*b*. Additionally, the framework 200 can be in communication with the shelving system 300, the folding system 400, and/or the adjustment system 500. Additionally or alternatively, the framework 200 can include a height A, and can be configured to transition between a first height and a second height using the adjustment system 500. Height A can range from approximately 18 inches to approximately 24 inches. The framework 200 can also be configured to maintain a height A using the adjustment system 500. Additional heights of the framework 200 are contemplated.

A first end of the multi-purpose member 206 can be attached to the first framework member 202*a*. Additionally, a second end of the multi-purpose member 206 can be attached to the second framework member 204*a*. The first and second ends of the multi-purpose member 206 can be attached using third and fourth pins 404*c*, 404*d*, respectively. The multi-purpose member 206 can indirectly connect the first framework member 202*a* to the second framework member 204*a*, thereby bracing the first and second plurality of framework members 202*a*, 204*a*. Additionally, the multi-purpose member 206 can be configured to receive an object or a load. Alternatively or in addition to, the multi-purpose member 206 can be attached to first and second plurality of framework members 202*b* and 204*b*.

The first and/or second plurality of framework members 202*a*, 202*b*, 204*a*, 204*b* can independently include one or more materials, for example: wood, aluminum, carbon fiber, glass fiber, steel, plastic, leather, or foam. The first plurality of framework members 202*a*, 202*b* and/or the second plurality of framework members 204*a*, 204*b* can independently include one or more cross-sections, for example: a circle, a rectangle, a triangle, or multi-sided polygons. The cross-section of the first and/or second plurality of framework members 202*a*, 202*b*, 204*a*, 204*b*, can independently be uniform along the length of the member. Alternatively, the cross-section of the first and/or second plurality of framework members 202*a*, 202*b*, 204*a*, 204*b*, can independently change along the length of the member. The cross-section can be solid or hollow. The first plurality of framework members 202*a*, 202*b* and/or the second plurality of framework members 204*a*, 204*b* can include one or more surface patterns, for example: a wave pattern, a ribbed pattern, or a helical pattern. The multi-purpose member 206 can include one or more materials, for example: wood, aluminum, carbon fiber, glass fiber, steel, plastic, leather, or foam. The multi-purpose member 206 can include one or more cross-sections, for example: a circle, a rectangle, a triangle, or multi-sided polygons. The cross-section can be solid or hollow. The multi-purpose member 206 can include one or more surface patterns, for example: a wave pattern, a ribbed pattern, or a helical pattern. It will be understood by a person of ordinary skill in the art that greater or fewer number of framework members and/or multi-purpose members can be utilized as required.

The shelving system 300 can include a first shelf tier 301 and/or a second shelf tier 308. As shown in FIG. 1B, the shelving system 300 can include a first position in the first configuration of the luggage rack system 100*a*. As shown in FIG. 1B, the shelving system 300 can include a second position in the second configuration of the luggage rack system 100*a*. Additional positions of the shelving system 300 are contemplated. The shelving system 300 can be in communication with the framework 200, the folding system 400, and/or the adjustment system 500. The first and/or second shelf tier 301, 308 can be configured to receive an article, such as a bag, thereon. Shelving system 300 can include greater or fewer number of shelf tiers, for example, a single shelf tier, two shelf tiers, three shelf tiers, four shelf tiers, and/or five shelf tiers. The shelf tiers can be arranged in a "stacked" configuration such that one shelf tier is either above or below another shelf tier. The shelf tiers can be arranged in a "lateral" configuration such that one shelf tier is adjacent to another shelf tier. The shelf tiers can be arranged in a configuration that is a combination of the "stacked" and "lateral" configurations, for example, a shelf tier can include another shelf tier above and yet another shelf tier adjacent.

The first shelf tier 301 can include a first shelf support structure 304. The first shelf support structure 304 can include a first shelf member 302. The first shelf member 302 can be in communication with the first shelf support structure 304. The first shelf member 302 can be attached to the first shelf support structure 304. The shelf member 302 can include one or more materials, for example: wood, aluminum, carbon fiber, glass fiber, steel, plastic, leather, or foam. The shelf member 302 can include one or more cross-sections, for example: a circle, a rectangle, a triangle, or multi-sided polygons. The cross-section of the shelf member 302 can be uniform along the length of the member. Alternatively, the cross-section of the shelf member 302 can change along the length of the member. The cross-section can be solid or hollow. The shelf member 302 can include one or more surface patterns, for example: a wave pattern, a ribbed pattern, or a helical pattern. In an example, shelf member 302 can include one or more surface grips, upholstery, padding, or any suitable material generally added to furniture. The first shelf tier 301 can include flexible webbing that can be configured to attach to the first shelf member 302 and/or the multi-purpose member 206. The flexible webbing can include one or more of: natural fibers, synthetic fibers, rubber, recycled PET, and/or any suitable material having desirable properties such as foldability, flexibility, and tensile strength.

The first shelf support structure 304 can include one or more support members, for example, a first support member 306*a*, a second support member 306*b*, third support member 306*c*, and/or fourth support member 306*d*. In an example, the first support member 306*a* and third support member 306*c* can be pivotably attached using, for example, a first pin 404*a* of the first folding mechanism 402, in a substantially "X" or "scissor" configuration. A first end of the first support member 306*a* can be attached to a shelf member, for example, shelf member 302. A second end of the first support member 306*a* can be in communication with the framework 200. The second end of the first support member 306*a* can include a first slot 406*c* of the folding system 400 disposed thereon. The second end of the first support member 306*a* can substantially abut a floor. The third support member 306*c* can include a first end attached to the multi-purpose member 206. The second end of the third support member 306*c* can substantially abut the floor. The second support member 306*b* and fourth support member 306*d* can be pivotably attached using, for example, a second pin 404*b* of the first folding mechanism 402, in a substantially "X" or "scissor" configuration. A first end of the second support member 306*b* can be attached to the first shelf member 302. A second end of the second support member 306*b* can be in communication with the framework 200. The second end of the second support member 306*b* can include a second sliding pin 406*b* of the folding system 400 disposed thereon. The second end of the second support member 306*b* can substantially abut a floor. The fourth support member 306*d* can include a first end attached to the multi-purpose member 206. The second end of the fourth support member 306*d* can substantially abut the floor. The first, second, third, and/or fourth support members 306*a*, 306*b*, 306*c*, 306*d* can independently include one or more materials, for example: wood, aluminum, carbon fiber, glass fiber, steel, plastic, leather, or foam. The first, second, third, and/or fourth support members 306*a*, 306*b*, 306*c*, 306*d* can independently include one or more cross-sections, for example: a circle, a rectangle, a triangle, or multi-sided polygons. The cross-sections of the first, second, third, and/or fourth support members 306*a*, 306*b*, 306*c*, 306*d* can independently be uniform along the length of the member. Alternatively, the cross-section of the first, second, third, and/or fourth support members 306*a*, 306*b*, 306*c*, 306*d* can independently change along the length of the member. The cross-section can be solid or hollow. The first, second, third, and/or fourth support members 306*a*, 306*b*, 306*c*, 306*d* can include one or more surface patterns, for example: a wave pattern, a ribbed pattern, or a helical pattern. It will be understood by a person of ordinary skill in the art that greater or fewer number of support structure members and/or shelf members can be utilized as required.

In the first position of the shelving system 300, the first and third support members 306*a*, 306*c* can be substantially perpendicular to each other, for example, in an "X" configuration. Additionally, in the first position of the shelving system 300, the second and fourth support member 306*b*, 306*d* can be substantially perpendicular to each other, for example, in an "X" configuration. Additionally, in the first position of the shelving system 300, the first shelf member 302 can be proximate the multi-purpose member 206, for example, the first shelf member 302 can be positioned substantially parallel to the multi-purpose member 206.

Turning to FIG. 1B, in the second position of the shelving system 300, the first and third support member 306*a*, 306*c* can be substantially non-perpendicular to each other. In the second position of the shelving system 300, the first and third support member 306*a*, 306*c* can be substantially non-perpendicular to each other. The first and third support member 306*a*, 306*c* can be attached using a pin, for example, the first pin 404*a* of the first folding mechanism 402. The second and fourth support member 306*b*, 306*d* can be attached using a pin, for example, the second pin 404*b* of the first folding mechanism 402.

Turning back to FIG. 1A, the second shelf tier 308 can include a second shelf member 310, a third shelf member 312, and a second shelf support structure 314. The second and/or third shelf members 310, 312 can be configured to receive an article, such as a bag, placed thereon. The second and/or third shelf support member 310, 312 can be attached to the second shelf support structure 314. The second and/or third shelf support member 310, 312 can be attached to the second shelf support structure 314. The second and/or third shelf support member 310, 312 can independently include one or more materials, for example: wood, aluminum, carbon fiber, glass fiber, steel, plastic, leather, or foam. The second and/or third shelf support member 310, 312 can independently include one or more cross-sections, for example: a circle, a rectangle, a triangle, or multi-sided polygons. The cross-section of the second and/or third shelf support member 310, 312 can independently be uniform along the length of the member. Alternatively, the cross-section of the second and/or third shelf support member 310, 312 can independently change along the length of the member. The second and/or third shelf support member 310, 312 can independently include one or more surface patterns, for example: a wave pattern, a ribbed pattern, or a helical pattern. Alternatively, or in variation thereof, shelf member 302 can include one or more surface grips, upholstery, padding, or any suitable material generally added to furniture. The second shelf tier 308 can include flexible webbing that can be configured to attach to the second shelf member 310 and/or the third shelf member 312. The flexible webbing can include one or more of: natural fibers, synthetic fibers, rubber, recycled PET, and/or any suitable material having desirable properties such as foldability, flexibility, and tensile strength.

The second shelf support structure 314 can include one or more support members, for example, a fifth support member 316*a*, and/or a sixth support member 316*b*. A first end of the fifth support member 316*a* can be attached to the second shelf member 310. A second end of the fifth support member 316*a* can be attached to the framework 200. The second end of the fifth support member 316*a* can be attached to the third shelf member 312. A first end of the sixth support member 316*b* can be attached to the second shelf member 310. A second end of the sixth support member 316*b* can be attached to the framework 200. The second end of the sixth support member 316*b* can be attached to the third shelf member 312. The fifth support member 316*a*, and/or a sixth support member 316*b* can include one or more materials, for example: wood, aluminum, carbon fiber, glass fiber, steel, plastic, leather, or foam. The fifth support member 316*a*, and/or a sixth support member 316*b* can include one or more cross-sections, for example: a circle, a rectangle, a triangle, or multi-sided polygons. The cross-sections of the fifth support member 316*a*, and/or a sixth support member 316*b* can be uniform along the length of the member. Alternatively, the fifth support member 316*a*, and/or a sixth support member 316*b* can change along the length of the member. The fifth support member 316*a*, and/or a sixth support member 316*b* can include one or more surface patterns, for example: a wave pattern, a ribbed pattern, or a helical pattern. It will be understood by a person of ordinary skill in the art that greater or fewer number of support structure members and/or shelf members can be utilized as required. It will be understood by one of skill in the art that shelf members, support members, multi-purpose members, and/or framework members can be attached to one another using fasteners, for example, one or more of: rivets, screws, bolts, nails, snap-press fittings, dowels, or the like.

In the first position of the shelving system 300, the fifth and/or sixth support members 316*a*, 316*b* can be substantially horizontal to the floor. In the first position, the fifth and/or sixth support members 316*a*, 316*b* can be substantially perpendicular to the first and/or second plurality of framework members 202*a*, 202*b*, 204*a*, 204*b*.

Turning to FIG. 1B, in the second position of the shelving system 300, the fifth and/or sixth support member 316*a*, 316*b* can substantially non-horizontal to the floor. In the second position, the fifth and/or sixth support members 316*a*, 316*b* can be substantially non-perpendicular to the first and/or second plurality of framework members 202*a*, 202*b*, 204*a*, 204*b*.

The folding system 400 can include a first folding mechanism 402 and/or a second folding mechanism 408. The folding system 400 can be configured to transition the luggage rack system 100*a* between the first configuration and the second configuration.

The first folding mechanism 402 can include a first pin 404*a*, a second pin 404*b*, a third pin 404*c*, a fourth pin 404*d*, a first sliding pin 406*a*, and/or a first slot 406*c*. As discussed above, the first pin 404*a* can attach the first and third support members 306*a*, 306*c* such that one member can rotate with respect to the other. The second pin 404*b* can attach the second and fourth support members 306*b*, 306*d* such that one member can rotate with respect to the other. The third pin 404*c* can attach the first end of the multi-purpose member 206 to the first framework member 202 such that the multi-purpose member 206 can rotate about an axis. The fourth pin 404*d* can attach the second end of the multi-purpose member 206 to the second framework member 204 such that the multi-purpose member can rotate about an axis. Additionally, the first folding mechanism 402 can include a first sliding pin 406*a*, a first slot 406*b*, a second sliding pin 406*b*, and/or a second slot 406*d*. The first sliding pin 406*a* and the first slot 406*b* can be a kinematic pair. The second sliding pin 406*c* and second slot 406*d* can be a kinematic pair. The first and/or second slots 406*b*, 406*d* can include a slotted length L, ranging from approximately 3 inches to approximately 8 inches. The first and/or second sliding pins 406*a*, 406*c* can be attached to the framework 200, for example, the first framework member 202*a* and/or the second framework member 204*a*, respectively. The first and/or second slots 406*b*, 406*d* can be attached to one or more support members (i.e. support members 306*a*-306*d*) of the first shelf support structure 304. The first sliding pin 406*a* can be configured to be inserted within the first slot 406*b*, the first sliding pin 406*a* configured to slide within the length L of the first slot 406*b*. The second sliding pin 406*c* can be configured to be inserted within the second slot 406*d*, the second sliding pin 406*c* configured to slide within the length L of the second slot 406*d*. The first folding mechanism 402 can be configured to transition the luggage rack system 100*a* between a first and second configuration, to transition the shelving system 300 between a first and second position, and/or to transition the first shelf tier 301 between a first and second position. The first and/or second sliding pins 406*a*, 406*c* can be integral to the first and/or second plurality of framework members 202*a*, 204*a*. Pins 404*a-d* can include one or more of: revolute joint, hinge joint, and/or the like. The first sliding pin 406*a* and the first slot 406*b* can include a kinematic pair, for example, a binding barrel and screw mechanism or a roller bearing mechanism. The second sliding pin 406*c* and second slot 406*d* can be a kinematic pair, for example, a binding barrel and screw mechanism or a roller bearing mechanism. The first and/or second sliding pins 406*a*, 406*c* can be attached to the first and/or second plurality of framework members 202*a*, 204*a*. The first and/or second slot 406*b*, 406*d* can be integral to the first and/or third support members 306*a*, 306*c*. The first and/or second slot 406*b*, 406*d* can be attached to the first and/or third support members 306*a*, 306*c*. It will be understood by one of skill in the art that greater or fewer pins, slots, and/or sliding pins can be utilized as required.

The second folding mechanism 408 can include a fifth pin 412*a*, a sixth pin 412*b*, a seventh pin 412*c*, an eighth pin 412*d*, a first folding system member 410*a* and/or a second folding system member 410*b*. A first end of the first folding system member 410*a* can be attached to the fifth support member 316*a*. The first end of the first folding system member 410*a* can be pivotably attached using the sixth pin 412*c*. A second end of the first folding system member 410*a* can be attached to the first plurality of framework members 202*a*, 202*b*. The second end of the first folding system member 410*a* can rest on the bar configured to receive aspects of the folding system 400. A first end of the second folding system member 410*b* can be attached to the sixth support member 316*b*. The first end of the second folding system member 410*b* can be pivotably attached using the eighth pin 412*d*. A second end of the second folding system member 410*b* can be attached to the second plurality of framework members 204*a*, 204*b*. The second end of the second folding system member 410*b* can rest on the bar configured to receive aspects of the folding system 400. The second end of the fifth support member 312*a* can be attached to the first plurality of framework members 202*a*, 202*b* using the fifth pin 412*a*. The second end of the sixth support member 312*b* can be attached to the second plurality of framework members 204*a*, 204*b* using the sixth pin 412*b*. The first and/or second folding system members 410*a*, 410*b* can include one from among: hinges, folding shelf brackets, and/or foldable bars. The pins 412*a-d* can include one or more of: revolute joint, hinge joint, and/or the like. It will be understood by one of skill in the art that the first and/or second folding system members 410*a*, 410*b* can be attached using fasteners including one or more of: rivets, screws, bolts, nails, snap-press fittings, dowels, or the like. It will be understood by one of skill in the art that greater or fewer pins, and/or folding system members can be utilized as required.

The adjustment system 500 can include a first adjustment mechanism 502 and/or a second adjustment system 504. The adjustment system can be in communication with the framework 200, the shelving system 300, and/or the folding system 400. The first and/or second adjustment mechanism 502, 504 can be disposed on the first and/or second plurality of framework members 202*a*, 202*b*, 204*a*, 204*b* respectively. The first and/or second adjustment mechanisms 502, 504 can be configured to adjust the height A of the framework 200 in discreet steps. Additionally, or alternatively to, the first and/or second adjustment mechanisms 502, 504 can be configured to adjust the height A of the framework 200 continuously. The first and/or second adjustment mechanisms 502, 504 can be configured to simultaneously adjust the height A of the first and second plurality of framework members 202*a*, 202*b*, 204*a*, 204*b*. The first and/or second adjustment mechanisms 502, 504 can be configured to independently adjust the height A of the first and second plurality of framework members 202*a*, 202*b*, 204*a*, 204*b*. The first and/or second adjustment mechanisms 502, 504 can be configured to synchronously adjust the height A of the first and second plurality of framework members 202*a*, 202*b*, 204*a*, 204*b*. The first and/or second adjustment mechanisms 502, 504 can be integral to the framework 200. The first and/or second adjustment mechanisms 502, 504 can be attached to the framework 200. The first and/or second adjustment mechanisms 502, 504 can be a telescoping mechanism, such that the first and/or second plurality of framework members 202*a*, 202*b*, 204*a*, 204*b* obtain a new height be telescoping. The first and/or second adjustment mechanisms 502, 504 can be shelf placement supports configured to receive one or more shelf tiers, such that one or more shelf tiers can be removed and placed at a new location on the shelf placement supports to obtain a new height. The shelf placement supports can include one or more of: clips, latches, notches, brackets, pins, grooves, and/or protrusions. It will be understood by one of skill in the art that the first and/or second adjustment mechanism 502, 504 can be attached using fasteners including one or more of: rivets, screws, bolts, nails, snap-press fittings, dowels, or the like.

The luggage rack system 100*a* can include a first locking mechanism configured to maintain the first and/or second plurality of framework members 202*a*, 202*b*, 204*a*, and 204*b* at a height A. The first locking mechanism can be configured to simultaneously lock the height of the first and second plurality of framework members 202*a*, 202*b*, 204*a*, 204*b*. The first locking mechanism can be configured to independently lock the height of the first and/or second plurality of framework members 202*a*, 202*b*, 204*a*, 204*b*. The first locking mechanism can be disposed on at least one of: the framework 200, the folding system 400, the shelving system 300, and/or the adjustment system 500. The first locking mechanism can be integral to at least one of: the framework 200, the folding system 400, the shelving system 300, and/or the adjustment system 500. The first locking mechanism can include at least one from among: a latch, a pin lock, or the like.

The luggage rack system 100*a* can include a second locking mechanism configured to maintain the first and/or second shelf tiers 301, 308 in their respective first position, second position, or contemplated intermediary position. The second locking mechanism can be configured to simultaneously lock the position of the first and second shelf tiers 301, 308. The locking mechanism can be configured to independently lock the height of the first and/or second shelf tiers 301, 308. The second locking mechanism can be disposed on at least one of: the framework 200, the folding system 400, the shelving system 300, and/or the adjustment system 500.

The second locking mechanism can be integral to at least one of: the framework 200, the folding system 400, the shelving system 300, and/or the adjustment system 500. The second locking mechanism can include at least one from among: a latch, a pin lock, or the like.

The luggage rack system 100*a* can include a one or more holding mechanisms configured to maintain a lid of a user's luggage in an open position to facilitate easier packing or unpacking of the user's belongings. One or more holding mechanisms can be disposed on at least one of: the framework 200, the folding system 400, the shelving system 300, and/or the adjustment system 500. One or more holding mechanisms can be integral to at least one of: the framework 200, the folding system 400, the shelving system 300, and/or the adjustment system 500. One or more holding mechanisms can include at least one from among: a retractable cord, a clip, and/or an adjustable strap. One or more holding mechanisms can include a combination of one from among: a retractable cord, a clip, and/or an adjustable strap.

Figure 2A:
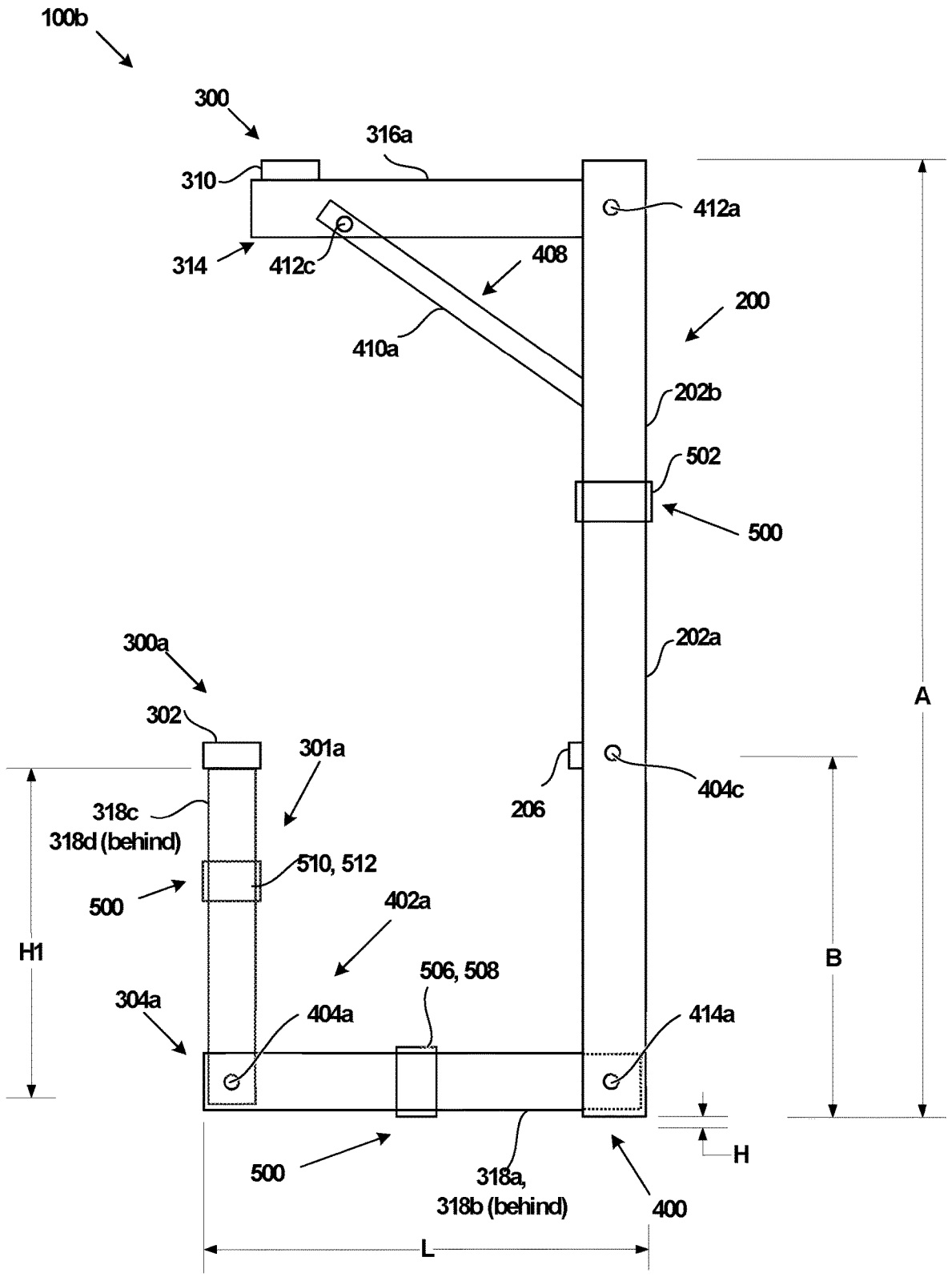
FIG. 2A-C illustrates aspects of an example luggage rack according to aspects of the present disclosure.
Figure 2B:
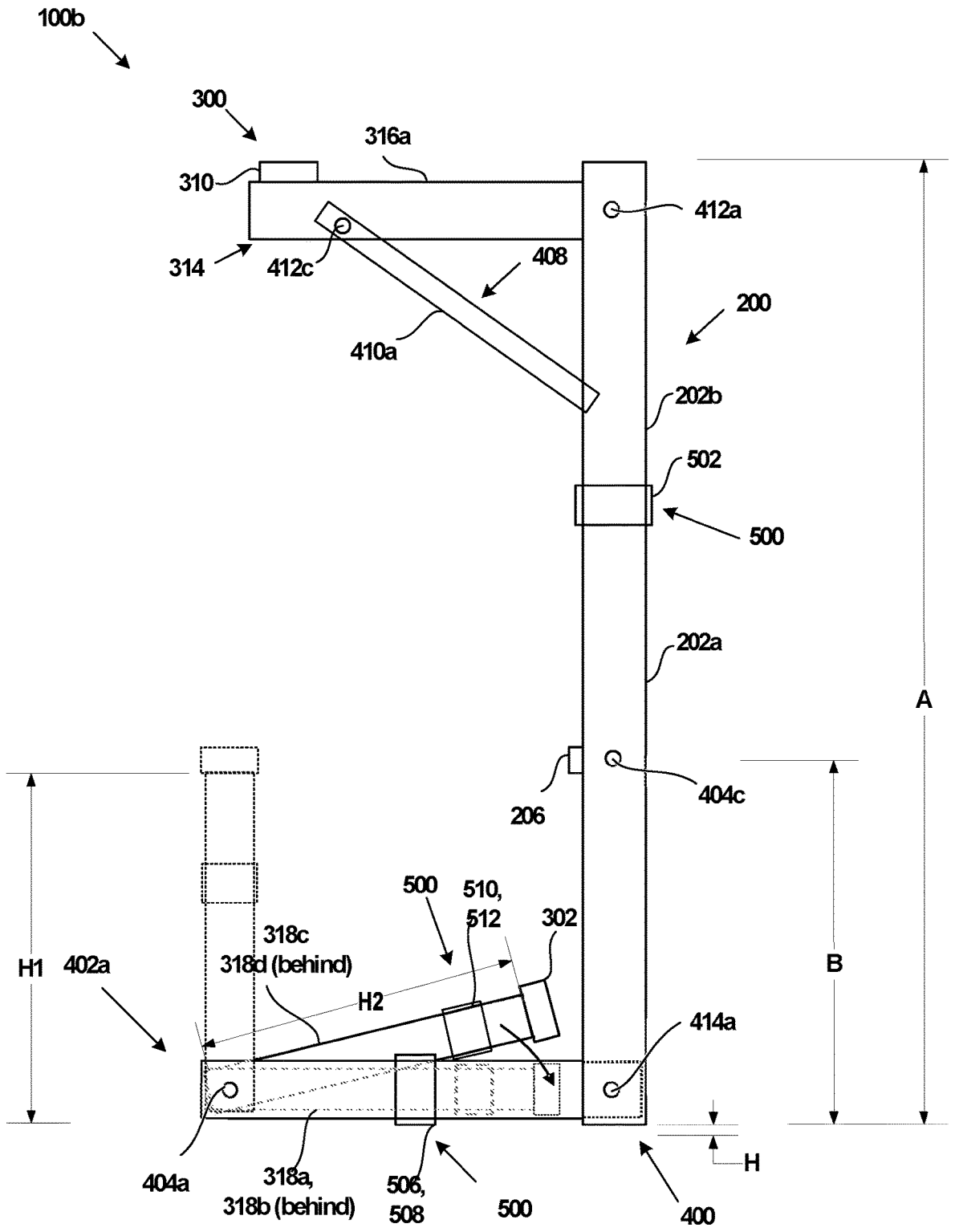
Figure 2C:
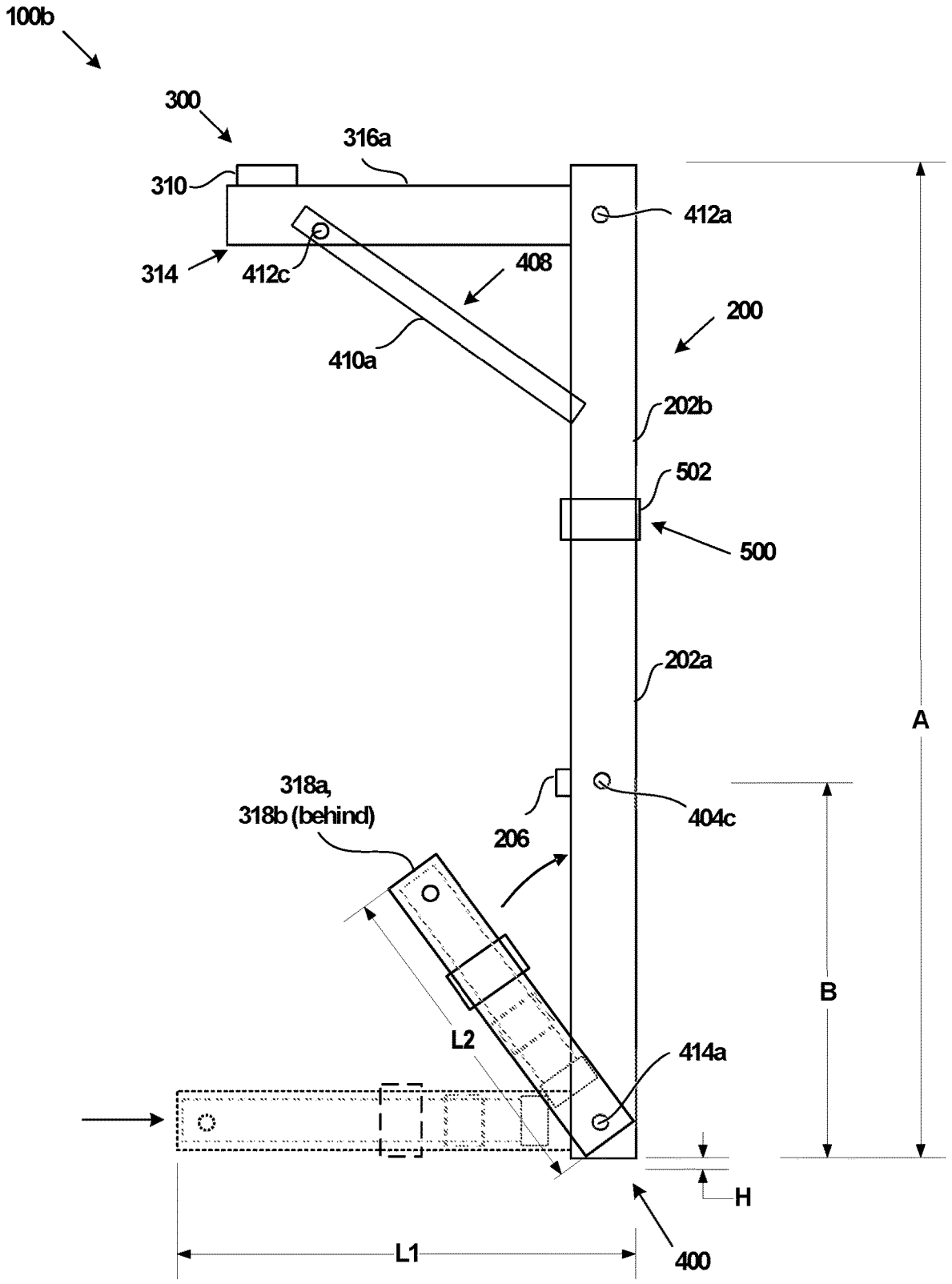

Turning to FIGS. 2A through 2C, an example luggage rack 100*b* can include a shelving system 300*a* and example first shelf tier 301*a*. First shelf tier 301*a* can include a first position in the first configuration of the luggage rack system 100*b*. As shown in FIG. 2B, the shelving system 300*a* can include an intermediate position and a second position in the second configuration of the luggage rack system 100*b* (FIGS. 2B and 2C, respectively). Additional positions of the first shelf tier 301*a* are also contemplated. As described above, the shelving system 300*a* can be in communication with the framework 200, the folding system 400, and/or the adjustment system 500. The first shelf tier 301*a* can include a first shelf support structure 304*a*. The first shelf support structure 304*a* can include the first shelf member 302. The first shelf member 302 can be in communication with the first shelf support structure 304*a*. The first shelf member 302 can be attached to the first shelf support structure 304*a*.

The first shelf support structure 304*a* can include one or more support members, for example, the first support member 318*a*, second support member 318*b*, third support member 318*c*, and/or fourth support member 318*d*. The first support member 318*a* can include a first end attached to the framework 200. The first end of the first support member 318*a* can include a ninth pin 414*a* of the folding system 400*a* disposed thereon. In the first configuration, the length of the first support member 318*a* can substantially abut the floor. The second support member 318*b* can include a first end attached to the framework 200. The first end of the second support member 318*b* can include a tenth pin 414*b* of the folding system 400*a* disposed thereon. In the first configuration, the length of the first support member 318*a* can substantially abut the floor.

The second end of the first support member 318*a* can be pivotably attached to a first end of the third support member 318*c* using, for example, the first pin or hinge 406*a* of the folding mechanism 402*a*, in a substantially "L" configuration. The second end of the second support member 318*b* can be pivotably attached to a first end of the fourth support member 318*d* using, for example, the second pin or hinge 406*b* of the folding mechanism 402*a*, in a substantially "L" configuration. The third and fourth support members 318*c*, 318*d* can include a second end attached to the first shelf member 302. The length of the first and second support members 318*a*, 318*b* can substantially abut a floor. The first end of the third and fourth support members 318*c*, 318*d*, attached to the first end of the first and second support members 318*a*, 318*b*, can substantially abut the floor.

The pins 404*a*, 404*b*, 414*a*, 414*b* can independently include one or more of: revolute joint, hinge joint, and/or the like. It will be understood by one of skill in the art that greater or fewer pins, and/or folding system members can be utilized as required.

In the expanded configuration, the first shelf tier 301 can be configured to contain a single-article luggage rack already on the market and typically found in hotel rooms. A single-article luggage rack can be contained within the first shelf tier 301 by sliding such single-article luggage rack within the "U" configuration formed from first support member 318*a*, second support member 318*b*, third support member 318*c*, and/or fourth support member 318*d* of first shelf support structure 304*a*.

As shown in FIGS. 2A through 2C, the first shelf tier 301 can include a shelf adjustment system 600 on the first support member 318*a*, the second support member 318*b*, the third support member 318*c*, and fourth support member 318*d* such that the height and width of the first shelf tier 301 can be adjusted.

The adjustment system 500 can include a first shelf adjustment mechanism 506, a second shelf adjustment mechanism 508, a third shelf adjustment mechanism 510 and a fourth shelf adjustment mechanism 512 in communication with the first shelf support structure 304*a*. The first, second, third, and/or fourth shelf adjustment mechanisms 506, 508, 510, and 512 can be disposed on the first, second, third, and/or fourth support members 318*a*, 318*b*, 318*c*, 318*d*, respectively. The first and/or second shelf adjustment mechanisms 506, 508 can be configured to adjust the length L of the first and second support members 318*a*, 318*b*. The third and/or fourth shelf adjustment mechanisms 510, 512 can be configured to adjust the height H of the third and/or fourth support members 318*c*, 318*d*. The shelf adjustment mechanisms, 506, 508, 510, 512 can independently be configured to adjust the height H and/or length L of the respective support members by discreet steps, continuously, simultaneously, independently, and/or synchronously. The first, second, third, and/or fourth shelf adjustment mechanisms 506, 508, 510, 512 can be integral to the first shelf support structure 304*a*. The first, second, third, and/or fourth shelf adjustment mechanisms 506, 508, 510, 512 can be attached to the first shelf support structure 304*a*. The first, second, third, and/or fourth shelf adjustment mechanisms 506, 508, 510, 512 can be a telescoping mechanism, such that the first, second, third, and/or fourth support members 318*a*, 318*b*, 318*c*, 318*d* obtain a new height and/or length by telescoping. It will be understood by one of skill in the art that the first, second, third, and/or fourth shelf adjustment mechanism 506, 508, 510, 512 can be attached using fasteners including one or more of: rivets, screws, bolts, nails, snap-press fittings, dowels, or the like.

As shown in FIG. 2B, the luggage rack 100*b* can include a folding mechanism that can be configured to transition the first shelf tier 301*a* from a first position to an intermediate position.

As shown in FIG. 2C, the luggage rack 100*b* can include a folding mechanism that can be configured to transition the first shelf tier 301*a* from an intermediate position to a second position. In the intermediate position of the shelving system 300, the third and fourth support members 318*c*, 318*d* can be configured to pivot around the first pins 404*a*, 404*b* to a collapsed position substantially over and/or within the first and second support members, 318*a*, 318*b*. In some embodiments, the shelf adjustment system 600 can be configured to adjust the height of third and fourth support members 318*c*, 318*d* from a first height H1 to a second height H2. As would be appreciated by one of skill in the art, adjusting third and fourth support members 318*c*, 318*d* can allow for placement of third and fourth support members 318*c*, 318*d* in alignment with first and second support members 318*a*, 318*b*.

Figure 4:
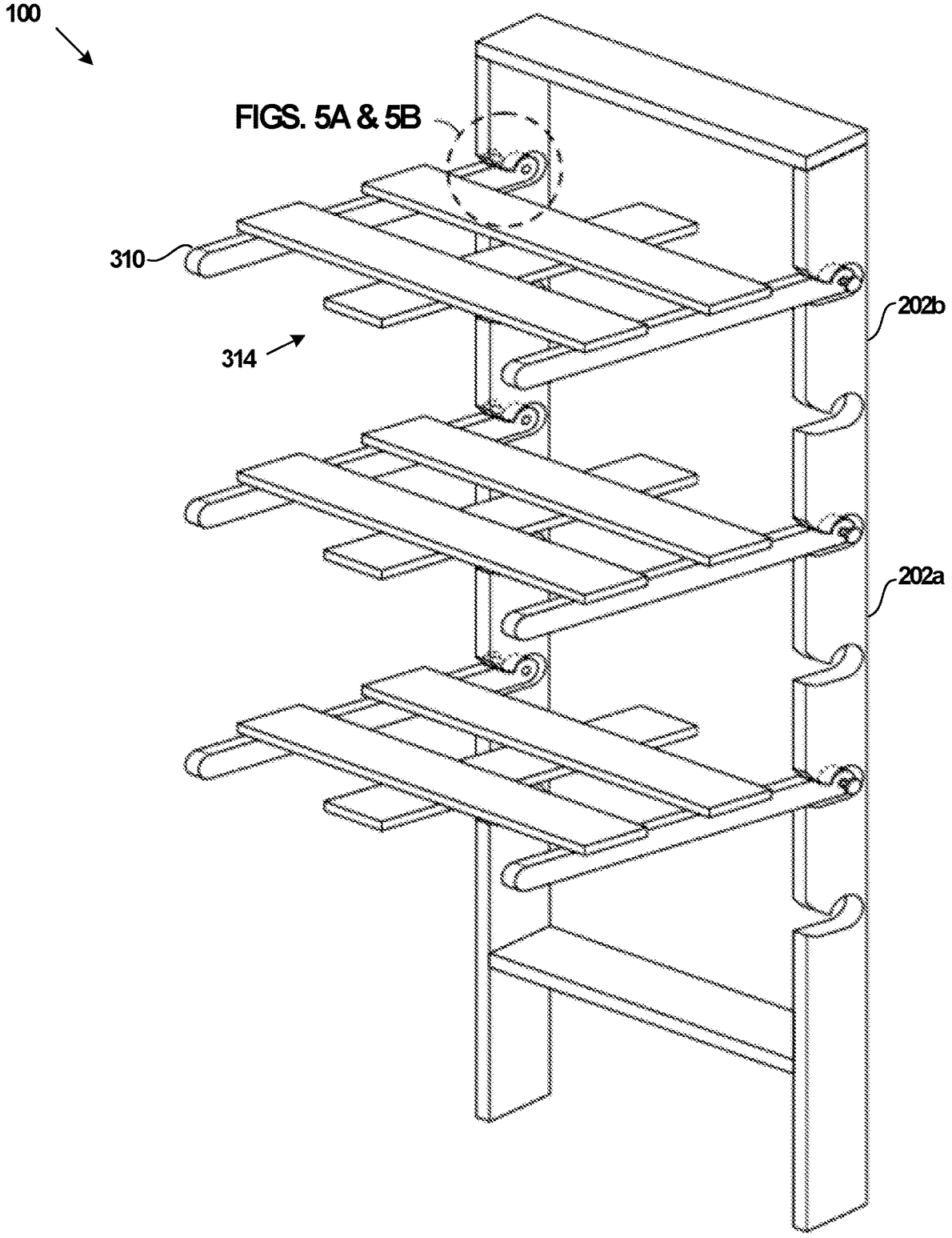
FIG. 4 illustrates aspects of another example luggage rack, according to aspects of the present disclosure.
Figure 5A:
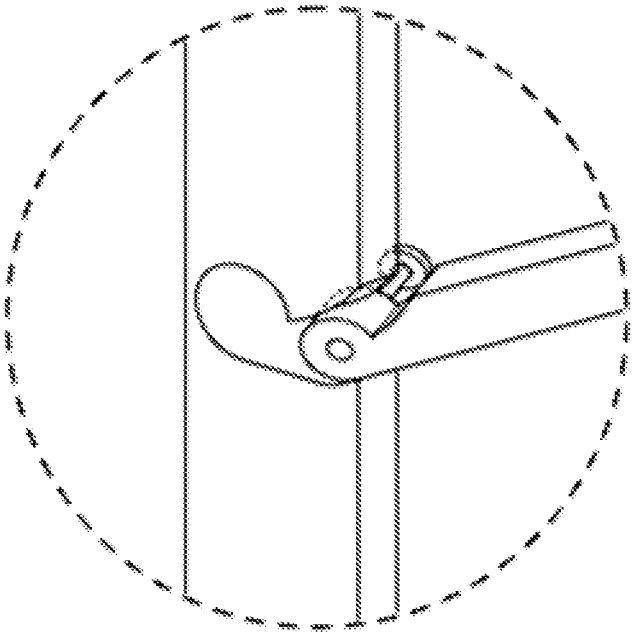
FIGS. 5A and 5B illustrate aspects of the example luggage rack of FIG. 4, according to aspects of the present disclosure.
Figure 5B:
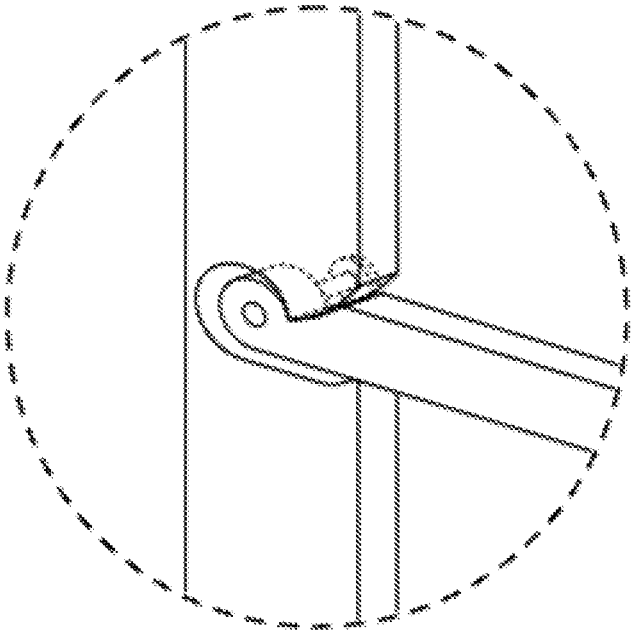

Furthermore, the second shelf member 310 can be configured to detachably attach from the first plurality of framework members 202*a*, 202*b*. In such a manner, the second shelf member 310 can detachably attach to the first plurality of framework members 202*a*, 202*b* without the second folding mechanism 408. As such, the first plurality of framework members 202*a*, 202*b* can comprise a plurality of slots into which the second shelf member 310 can be laterally inserted, as shown in FIG. 4. Each of the plurality of slots can comprise teeth configured to hold the second shelf member 310 therein. Particularly, the second shelf support structure 314 can comprise a tapered section on the end connected to the first plurality of framework members 202*a*, 202*b* such that the second shelf support structure 314 can mate with the plurality of slots, as shown in FIGS. 5A and 5B. In such a manner, the height A of the second shelf member 310 can be adjusted based on which slot from the plurality of slots that the second shelf support structure 314 is inserted into. Furthermore, the tapered section of the second shelf support structure 314 can comprise a notch corresponding to the teeth in each of the plurality of slots. In such a manner, the second shelf support structure 314 can be securely held in place. It is to be understood that, even though the above description relates to the first plurality of framework members 202*a*, 202*b* and the second shelf member 310, any number of shelves can be detachably attached to the plurality of slots as desired by those skilled in the art.

Each of the plurality of slots can be positioned at a predetermined distance away from each other along the first plurality of support members 202*a*, 202*b*. In such a manner, the second shelf support structure 314, and therefore the second shelf member 310, can be positioned at any desired height along the height A. Each of the plurality of slots can comprise a raised detent, or tooth therein, to correspond to a notch in the second shelf support structure 314. The plurality of slots can be included in addition to, or in lieu of, the first pin 412*a*. In some examples, the first pin 412*a* can be used to further attach the second shelf support structure 314 to the plurality of slots.

Additionally, as shown in FIG. 4, the luggage rack system 100*a* can be free-standing or mounted on an external surface, such as a wall. In such a manner, the luggage rack system 100*a* can eliminate the need for external support members and reduce the space required for attached support structures to allow the luggage rack system 100*a* to stand vertically. As would be appreciated, the luggage rack system 100*a* can be mounted to a wall or other external surface in a variety of ways known to those of ordinary skill in the art.

Figure 3:
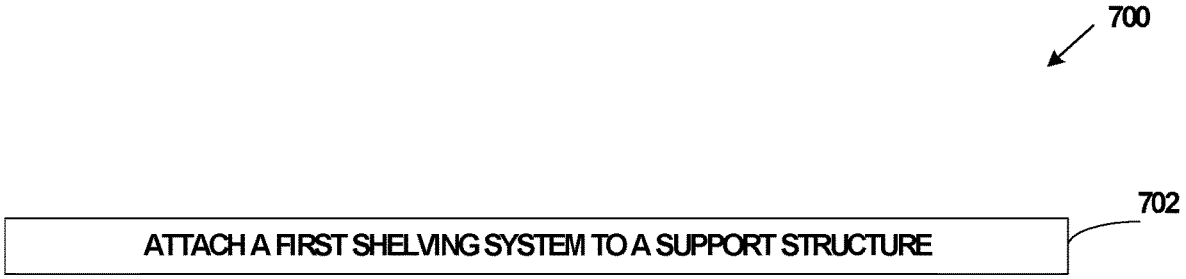
FIG. 3 is a flowchart illustrating an example method of construction for an example luggage rack, according to aspects of the present disclosure.

FIG. 3 is a flowchart of a method 600 of assembling a luggage rack (e.g. luggage rack system 100*a*), according to an example. In the second position of the shelving system 300, the first and second support members 318*a*, 318*b* can be configured to pivot around the ninth and tenth pins 414*a*, 414*b* to a collapsed position substantially over and/or within the framework 200. In some embodiments, the shelf adjustment system 600 can be configured to adjust the height of first and second support members 318*a*, 318*b* from a first length L1 to a second length L2. As would be appreciated by one of skill in the art, adjusting first and second support members 318*a*, 318*b* can allow for placement of the first and second support members 318*a*, 318*b* in alignment with first and second plurality of framework members 202*a*, 204*a*, respectively.

At block 602, the method can include attaching a shelf tier (i.e. first shelf tier 301 and/or second shelf tier 308) to a framework (i.e. framework 200) such that the shelf tier can be operable to transition between a first position of the shelf tier and a second position of the shelf tier, and such that the framework can be operable to transition between a first position of the framework and a second position of the framework.

Additionally or alternatively, attaching a shelf tier to the framework can include coupling a first shelf support member to a second shelf support member such that the first shelf support member and the second shelf support member can be rotatable about a first axis. attaching a shelf member at a first end of the first shelf support member, attaching a multi-purpose member at a first end of the second shelf support member, attaching a first end of the multi-purpose member to a framework member such that the multi-purpose member can be rotatable about a second axis; and attaching a second end of the first shelf support member to a first end of the framework member such that the framework member can slide with respect to the first shelf support member.

Additionally or alternatively, the shelf tier can be a first shelf tier, and the method can include attaching a second shelf tier to the framework such that the second shelf tier can be operable to transition between a first position of the second shelf tier and a second position of the second shelf tier.

Additionally or alternatively, attaching a second shelf tier to the framework can include attaching a shelf member to a first end of a shelf support member, attaching a second shelf member to a second end of the shelf support member, and attaching the second end of the shelf support member to an end of a framework member such that the shelf support member can be rotatable with respect to the framework member.

Certain examples and implementations of the disclosed technology are described above with reference to block and flow diagrams of systems and methods according to examples or implementations of the disclosed technology. It will be understood that some blocks of the block diagrams and flow diagrams may not necessarily need to be performed in the order presented, may be repeated, or may not necessarily need to be performed at all, according to some examples or implementations of the disclosed technology.

In this description, numerous specific details have been set forth. It is to be understood, however, that implementations of the disclosed technology may be practiced without these specific details. In other instances, well-known methods, structures and techniques have not been shown in detail in order not to obscure an understanding of this description. References to "one embodiment," "an embodiment," "some embodiments," "example embodiment," "various embodiments," "one implementation," "an implementation," "example implementation," "various implementations," "some implementations," etc., indicate that the implementation(s) of the disclosed technology so described may include a particular feature, structure, or characteristic, but not every implementation necessarily includes the particular feature, structure, or characteristic. Further, repeated use of the phrase "in one implementation" does not necessarily refer to the same implementation, although it may.

Throughout the specification and the claims, the following terms take at least the meanings explicitly associated herein, unless the context clearly dictates otherwise. The term "connected" means that one function, feature, structure, or characteristic is directly joined to or in communication with another function, feature, structure, or characteristic. The term "coupled" means that one function, feature, structure, or characteristic is directly or indirectly joined to or in communication with another function, feature, structure, or characteristic. The term "or" is intended to mean an inclusive "or." Further, the terms "a," "an," and "the" are intended to mean one or more unless specified otherwise or clear from the context to be directed to a singular form. By "comprising" or "containing" or "including" is meant that at least the named element, or method step is present in article or method, but does not exclude the presence of other elements or method steps, even if the other such elements or method steps have the same function as what is named.

As used herein, unless otherwise specified the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

As used herein, unless otherwise specified the use of the adjective "secure", "secured," etc., is intended to mean non-permanently fixed or fastened so as not to give way, become loose, or be lost.

While certain examples of this disclosure have been described in connection with what is presently considered to be the most practical and various examples, it is to be understood that this disclosure is not to be limited to the disclosed examples, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain examples of the technology and also to enable any person skilled in the art to practice certain examples of this technology, including making and using any apparatuses or systems and performing any incorporated methods. The patentable scope of certain examples of the technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A luggage rack comprising:

a first framework member spaced apart from a second framework member;

a first shelf tier comprising:

a first shelf support structure; and a first shelf member connected to a portion of the first shelf support structure; and a folding system configured to transition the luggage rack between a retracted configuration and an extended configuration;

wherein the first and second framework members each extend vertically, and remain in a constant vertical orientation through luggage rack transition;

wherein a distal portion of the first shelf tier comprises a portion of the first shelf member;

wherein the first shelf support structure comprises:

a first support member;

a second support member;

a third support member; and a fourth support member;

wherein the first support member is pivotally attached to the third support member;

wherein the second support member is pivotally attached to the fourth support member;

wherein the first support member and the second support member each have a first end abutting the first shelf member and a second end attached to the respective first framework member and second framework member;

wherein the first support member and the third support member are in an "X" configuration in an extended orientation of the first shelf tier that is associated with the extended configuration of the luggage rack;

wherein the second support member and the fourth support member are in the "X" configuration in the extended orientation of the first shelf tier;

wherein the first shelf tier has a retracted orientation associated with the retracted configuration of the luggage rack;

wherein the extended and retracted orientations of the first shelf tier are different, the orientation of the first shelf tier being variable through luggage rack transition;

wherein, when in the extended orientation, the distal portion of the first shelf tier is a maximum distance from the first and second framework members;

wherein, when in the retracted orientation, the distal portion of the first shelf tier is a minimum distance from the first and second framework members;

wherein a length of the luggage rack is defined by the distance between the distal portion of the first shelf tier and the first and second framework members; and wherein the length of the luggage rack in the retracted configuration is shorter than the length of the luggage rack in the extended configuration.

2. The luggage rack of claim 1 further comprising:

a first folding mechanism configured to transition the first shelf tier between the extended and retracted orientations;

wherein the first folding mechanism is configured to transition the first support member, the third support member, the second support member, and the fourth support member from the "X" configuration in the extended orientation to a non-perpendicular configuration in retracted orientation.

3. The luggage rack of claim 1, wherein, in the extended configuration of the luggage rack, each of the first and second framework members substantially abuts a floor.

4. The luggage rack of claim 1, wherein, in the retracted configuration of the luggage rack, each of the first and second framework members includes a distance between the framework members and a floor.

5. The luggage rack of claim 1 further comprising:

an adjustment system configured to transition the first and second framework members between a first and a second height;

wherein the adjustment system comprises:

an adjustment mechanism disposed on at least one of: the first shelf tier or the framework members; and a locking mechanism configured to lock the framework members at the first height or the second height.

6. The luggage rack of claim 1 further comprising:

a second shelf tier comprising:

a second shelf member; and a second shelf support structure;

wherein the second shelf tier has an extended orientation associated with the extended configuration of the luggage rack and a retracted orientation associated with the retracted configuration of the luggage rack.

7. The luggage rack of claim 6 further comprising:

a second folding mechanism configured to transition the second shelf tier between the extended and retracted orientations.

8. The luggage rack of claim 7, wherein the second folding mechanism comprises:

a first end of a second folding mechanism member attached to the second shelf tier; and a second end of the second folding mechanism attached to each of the first and second framework members.

9. The luggage rack of claim 1 further comprising:

a multi-purpose member attached to the first shelf tier and configured to brace each of the first and second framework members, and receive one or more objects placed on the multi-purpose member;

wherein the multi-purpose member comprises:

a first end attached to the first framework member; and a second end attached to the second framework member.

10. The luggage rack of claim 6, wherein the second shelf support structure comprises:

one or more second shelf support structure support members;

wherein one of the second shelf support structure support members is in a substantially perpendicular configuration with respect to one of the first and second framework members in the extended orientation of the second shelf tier.

11. The luggage rack of claim 6, wherein the second shelf support structure comprises:

one or more shelf support structure second support members;

wherein one of the second shelf support structure support members is in a substantially non-perpendicular configuration with respect to one of the first and second framework members in the retracted orientation of the second shelf tier.

* * * * *